United States Patent [19]

Moore

[11] Patent Number: 4,539,721

[45] Date of Patent: Sep. 10, 1985

[54] FREE-STANDING SHOWER

[75] Inventor: John W. Moore, St. Louis County, Mo.

[73] Assignee: The Swan Corporation, St. Louis, Mo.

[21] Appl. No.: 598,500

[22] Filed: Apr. 9, 1984

[51] Int. Cl.[3] ..... A47K 3/22

[52] U.S. Cl. ..... 4/613; 4/614; 52/264

[58] Field of Search ..... 4/612–614, 4/599, 600, 596; 52/588, 594, 264, 34, 35, 287, 288

[56] References Cited

U.S. PATENT DOCUMENTS

| | | | |
|---|---|---|---|
| 1,860,968 | 5/1932 | Tracy | 4/614 |
| 2,106,516 | 1/1938 | Cheney | 4/613 |
| 3,757,358 | 9/1973 | Chisholm et al. | 52/34 X |
| 3,800,335 | 4/1974 | Buonaura | 4/613 |
| 3,895,398 | 7/1975 | Mustee | 4/613 |
| 4,329,744 | 5/1982 | Cuschera | 4/613 X |

FOREIGN PATENT DOCUMENTS

| | | | |
|---|---|---|---|
| 1131675 | 2/1957 | France | 4/613 |
| 1339901 | 12/1973 | United Kingdom | 4/614 |

*Primary Examiner*—Charles E. Phillips
*Attorney, Agent, or Firm*—Kalish & Gilster

[57] ABSTRACT

A free-standing shower permits remote drain discharge, having a shower cabinet with wall structure defining a peripheral base edge fitted upon or interengaged with a base extension formed of identical, interlocked members. A lightweight, foam material sub-base is provided under the shower floor, which is raised above the supportive surface by the base extension. The sub-base guides and locates a drain pipe assembly including a drain pipe which extends laterally through and beyond the sub-base to permit drain discharge at a location remote from the shower.

7 Claims, 7 Drawing Figures

FIG. 1
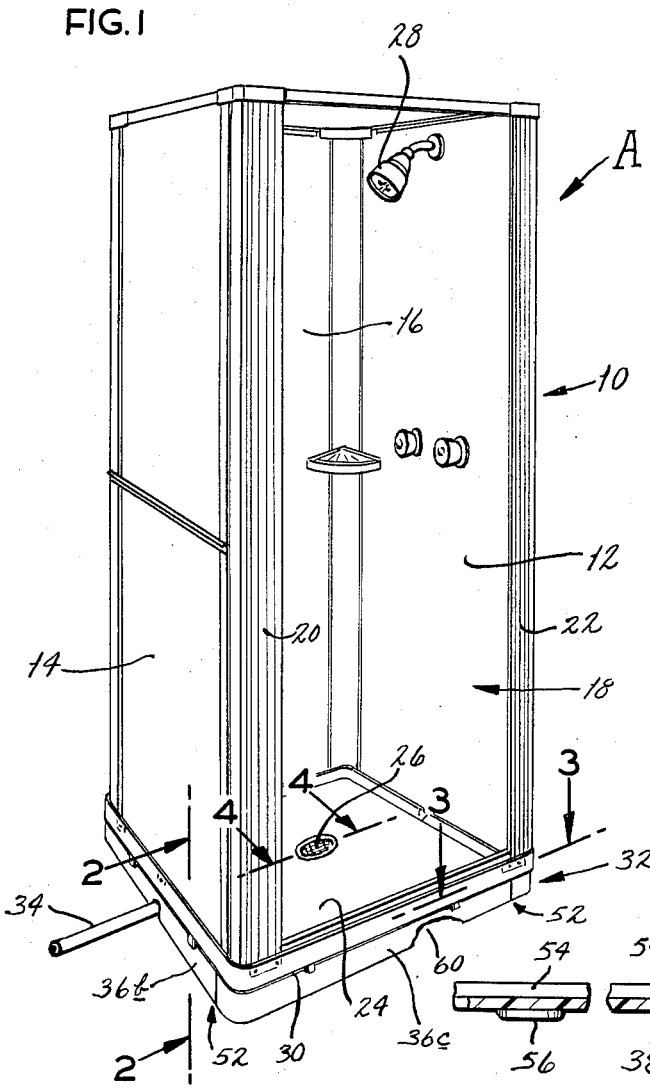
FIG. 2
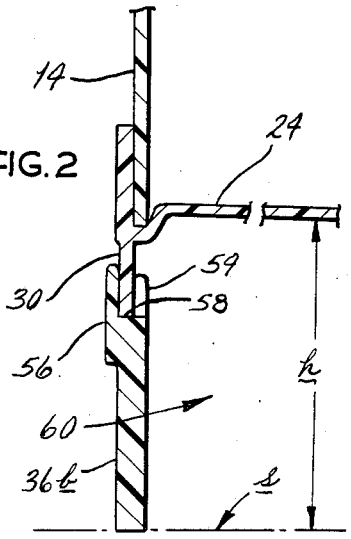
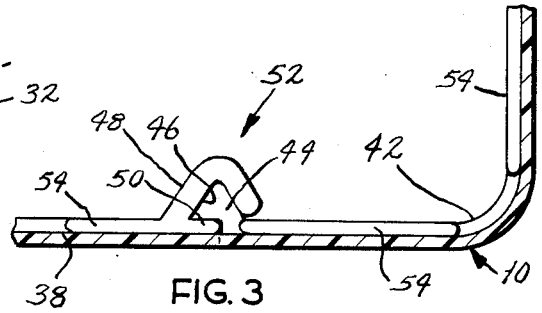
FIG. 3
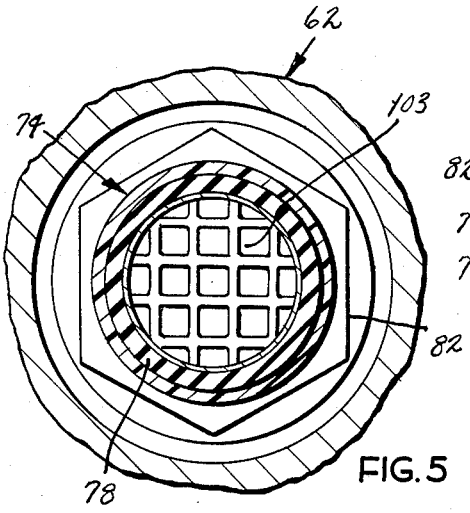
FIG. 5
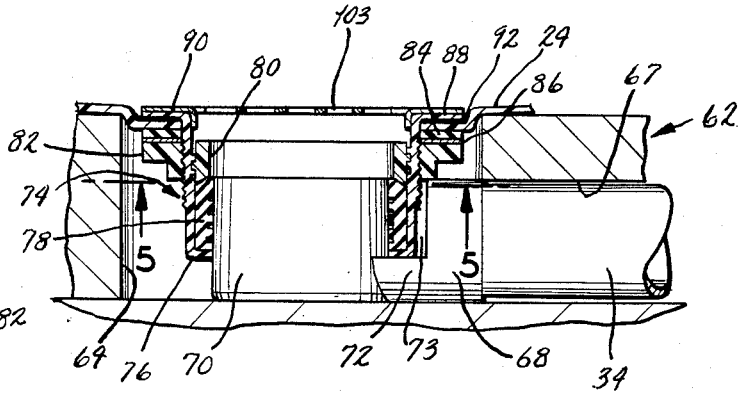
FIG. 4

FREE-STANDING SHOWER

BACKGROUND AND SUMMARY OF THE INVENTION

This invention relates generally to shower constructions and, more particularly, to an improved free-standing shower permitting remote drain discharge.

Showers of the free-standing type have been known before, as in Moore U.S. Pat. No. 3,390,407; and there are widely available many different commercially produced shower cabinet constructions of various shapes, including rectangular, and of various different possible materials including fiberglass, synthetic resin material, and thermoplastic, as well as metal.

A substantial concern is the need for a drain for the shower. If the cabinet is closed at the bottom with an internal floor, provision must be made for draining the floor by communication with an existing drain. Heretofore, this has required the breaking into subfloor drain lines which may necessitate breaking away concrete or drilling, etc., and in any event requiring a substantial effort on the part of a plumber. However, in many residences and other facilities in which free-standing showers may be utilized, such as in a residential basement, there are existing floor drains which one would prefer to utilize. However, it is typically inconvenient to position the shower cabinet directly over an existing floor drain, so that there is a need to provide a remote drain discharge. Such heretofore has necessitated expensive and undesirable constructions, as well as resort to such expedients as the construction of wodden platforms and the like upon which the shower cabinet is to be placed, and thereby permitting access below the shower cabinet for the connection of conventional plumbing componetns. A platform installation is disadvantageous not only from the viewpoint of appearance, but also in necessitating an extrinsic physical structure of obviously undesirable character as well as requiring climbing of steps, and so forth, to utilize the shower.

It is an object of the present invention to provide a free-standing shower including plumbing components already installed therein for permitting remote drain discharge, and allowing the shower to drain into an existing floor drain without resort to extrinsic structure, elaborate plumbing or makeshift expedients such as platforms and the like.

It is a further object of the invention to provide such a free-standing shower which is rapidly and easily assembled by even a technically unsophisticated person such as a homeowner or other unskilled user, without the need for special tools or time-consuming elaborate effort.

It is a related object of the invention to provide such a free-standing shower which includes elements which guide and locate plumbing components therein for facile, simplified connection of same to the drain of the shower.

It is additionally an object of the invention to provide such a free-standing shower which, in spite of permitting remote drain discharge, does not objectionably raise the floor of the shower cabinet above the supportive surface upon which the shower is located, and which additionally provides for even distribution of the weight applied to the shower cabinet floor to a relatively large area beneath the shower cabinet, thereby supporting even very heavy persons without concern for injury to the shower cabinet floor or the application of stress or strain to the plumbing elements of the shower, such as might otherwise cause leakage and fracturing or other damage to them.

The invention has also an object the provision of such a free-standing shower which is modern-looking, attractive in appearance, and allows remote discharge unobtrusively.

Additionally, an object of the present invention is to provide such a free-standing shower which utilizes components which are inherently long-lasting and resistant to corrosion, breakage, water damage or other degredation in use.

Briefly, a free-standing shower of the present invention includes a shower cabinet having a wall structure including a peripheral base edge at its lower end. The shower cabinet includes an internal floor with a central drain. A base extension is provided which is seated upon a supportive surface, such as a floor, for receiving and supporting the base edge around its periphery for slightly elevating the cabinet floor slightly to define a space between it and the supportive surface. A sub-base is provided within such space for supporting the cabinet floor and evenly distributing weight thereon to a relatively large area beneath the shower cabinet. The sub-base includes a drain pipe assembly which is fixed in location within the sub-base for connection to the central drain of the shower cabinet. The drain type assembly includes a drain pipe extending laterally through and beyond the base extension, thereby allowing it to be extended to an existing floor drain at a point remote from the shower.

Other objects and features will be in part apparent and in part pointed out hereinbelow.

BRIEF DESCRIPTION OF THE DRAWINGS

FIG. 1 is a perspective view of a free-standing shower configured in accordance with and embodying the present invention.

FIG. 2 is an enlarged fragmentary vertical cross section taken generally along line 2—2 of FIG. 1.

FIG. 3 is an enlarged fragmentary transverse cross section taken generally along line 3—3 of FIG. 1.

FIG. 4 is an enlarged fragmentary vertical cross section of certain drain components, and taken generally along line 4—4 of FIG. 1.

FIG. 5 is an enlarged fragmentary plan view of a central floor drain of the shower.

Corresponding reference characters indicate corresponding parts throughout the several views of the drawings.

DESCRIPTION OF THE PREFERRED EMBODIMENT

Figure 6:
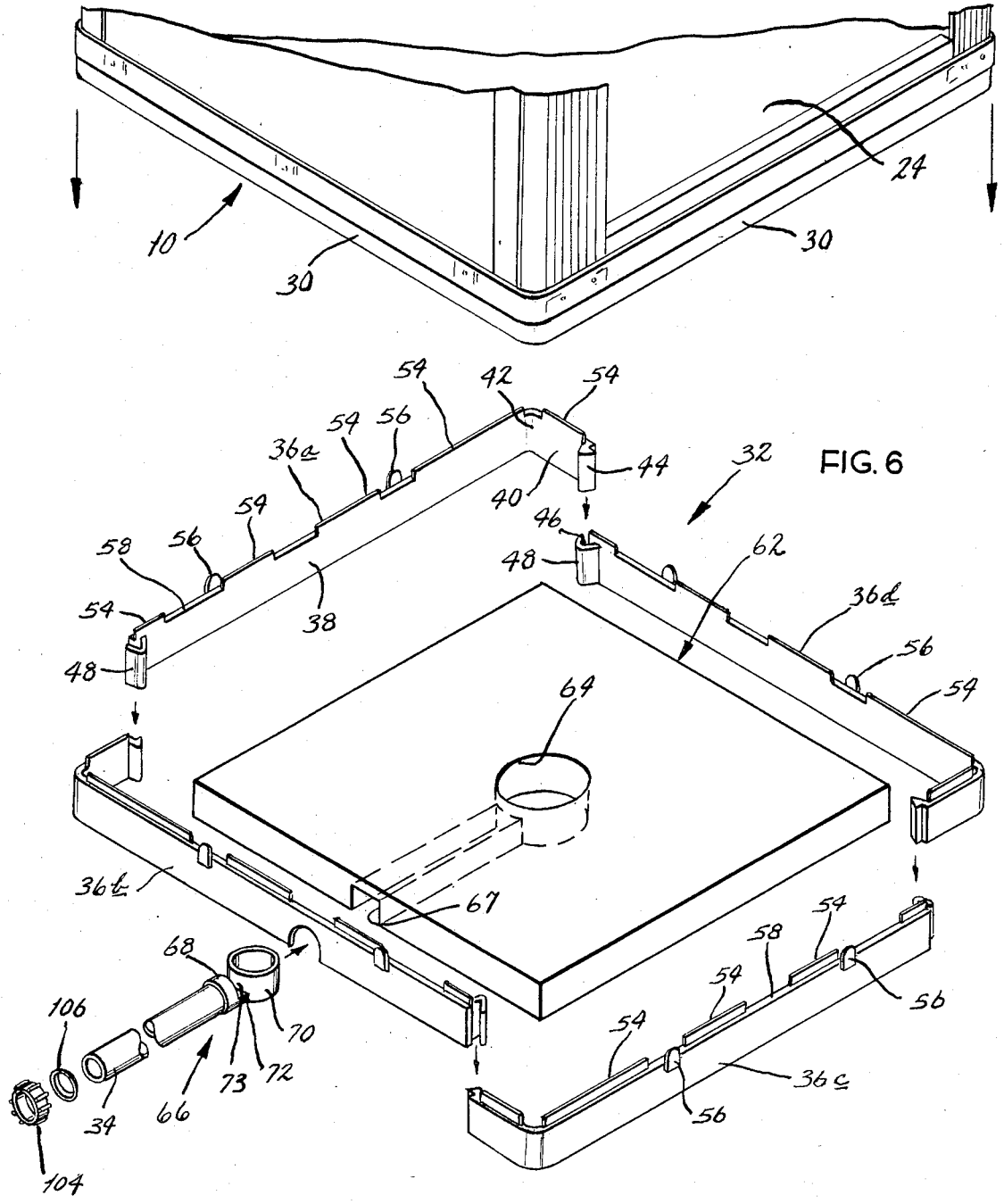
FIG. 6 is an exploded fragmentary perspective view of portions of a shower cabinet and a base extension, sub-base and a plumbing assembly utilized for permitting remote drain discharge.
Figure 7:
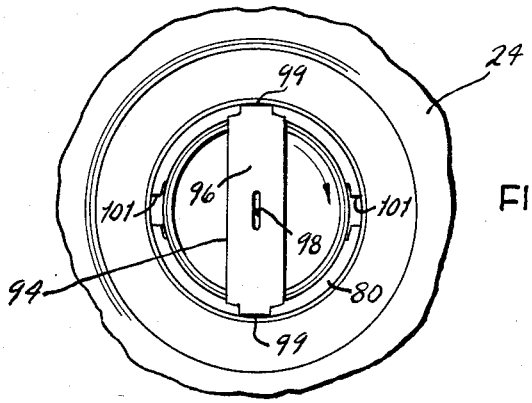
FIG. 7 is a fragmentary plan view similar to FIG. 5 and illustrating installation of the drain components during assembly of the shower.

Referring now by reference characters to the drawings, illustrated generally at A is a free-standing shower in accordance with the invention. Shower A permits remote drain discharge, i.e., at a location remote from the shower, as to a floor drain of existing character such as in the basement of a residential premises, or a patio, or other surface drain.

Shower A, being of free-standing nature, is intended to be self-supported and need not be adapted to extrinsic structure or otherwise supported by the surrounding premises or structure. It includes a shower cabinet generally designated 10 having a wall structure consisting of side walls 12, 14 and a rear wall 16 defining an opening 18 including door edge portions or jambs 20, 22 to either of which may be hinged a swinging door (not shown); or alternatively there may be utilized a shower curtain. Cabinet 10 includes also a floor 24 having a central drain 26 for draining water entering cabinet from the usual shower head 28.

The construction of cabinet 10 is thus seen to be of generalized, conventional nature, and may utilize known materials of construction, such as fiberglass, ABS, PVC, various other synthetic resin materials and thermoplastics, coated steel, aluminum alloy and other composite materials. In any event, such cabinet is formed, as is conventional, of relatively thin sheets of the materials of construction and whereby floor 24 (FIG. 2) is of relatively thin character, as also are the walls.

Typically, cabinet 10 defines a peripheral base edge at its lower end, such as the flange 30 shown in FIG. 2 which is further integral with floor 24, said flange 30 extending fully around the periphery of cabinet 10 and utilizable for fitting the shower cabinet 10 alone upon a supportive surface s such as a concrete floor, etc., and with drain 26 being connected by conventional plumbing to existing drain pipes.

However, in accordance with the present invention, cabinet 10 is not so supported, but rather is interengaged with a base extension generally designated 32 for permitting remote drain discharge by means of a drain pipe 34 extended remotely from shower cabinet 10, as noted.

More specifically, base extension 32 is formed of four extension frame pieces 36*a*–36*d* (FIG. 6) as preferably formed of strong, durable, stiffly resilient synthetic resin material or thermoplastic such as ABS or PVC, and of identical configuration. Thus, considering frame piece 35*a* as exemplary, each such piece includes an elongated portion 38 and an integral short portion 40 extending at a right angle to the elongated portion but defining a rounded corner 42 which will define the corresponding corner of base extension 32.

At the outer end of each short portion 40 is a wedge shaped extension 44 (see also FIG. 3) configured for being received tightly within a corresponding receptacle 46 defined by a V-shaped structure 48 at the outer end of the long portion 38 of the adjacent extension frame piece. Thus, member 44 of piece 36*a* is received within recess 46 of piece 36*d*, and so formed, to provide a strong, secure, mutually interlocked relationship of the four frame pieces. As will be noted from FIG. 3, each such wedge-shaped member 44 includes also a recess 48 of L-shaped character for accommodating a corresponding extension 50 of the adjacent elongated portion 38 for enhancing the security and rigidity of the union provided by such interengaging members. Accordingly, four reliable joints 52 are provided at intervals around base extension 32 but without detracting from finished appearance.

For receiving the peripheral flange or edge 30, each of extension frame pieces 36*a*–36*d* is provided on its upper surface with a series of upstanding, interrupted ribs or flanges as at 54, as well as short tabs 56 integrally formed on the outer surface of each extension frame member and extending upwardly from its upper surface 58 for providing a channel to slidingly receive the peripheral flange 30 with sufficient friction and grip that base extension 32 and shower cabinet 10 will remain interengaged at all times during normal use.

Accordingly, base extension 32 slightly elevates floor 24 from the supportive surface to define beneath floor 24 and the supportive surface a rectangular space 60 in which is received a sub-base generally designated 62. The sub-base is formed of a single block of finished styrofoam which is of lightweight, porous character and of rectangular configuration and horizontal dimensions substantially less than base extension 32 but sufficient for occupying a significant portion of said space 60 and for supporting cabinet floor 24 over a relatively large part of its surface area. In this regard, sub-base 62 is of sufficient thickness for substantially filling the clearance height h between the supportive surface s between cabinet floor 24 proximate drain 26 whereby weight applied to cabinet floor 24 will be supported and distributed by sub-base 62 without substantial stress and strain to a drain pipe assembly generally designated 66.

Sub-base 62 is provided with central cylindrical opening 64 from which radially extends a tunnel-like recess 67 of rectangular section to the outer edge of the sub-base for receiving and guiding a drain pipe assembly 66, including said drain pipe 34. The latter is received by a sleeve 68 (FIG. 4) extending laterally from a drain fitting 70.

Fitting or fixture 70 is joined to sleeve 68 by a fhort lateral extension 72 of the latter to provide a trap-like configuration, and providing a recess 73 for clearance of a drain body 74. Fitting 70, being circular in section, is received within a drain body 74 which includes a flange 76 at its lower end against which is fitted a rubber seal 78. Seal 78 is tightened in place around fitting 70 by screwing down of an annular so-called caulking nut 80 threaded into drain body 74. The drain body is itself secured to cabinet floor 24 by a lock nut 82 exteriorly threaded upon drain body 74 for clamping washers 84, 86 against the bottom edge of a flange 88 from the drain aperture in cabinet floor 24, and thereby drawing a drain body flange 90 against said flange 88, as well as caulking material 92 provided therebetween if desired.

In the preferred mode of usage, sub-base 62 containing drain pipe assembly 66 is located in the desired position within sub-base 32. With drain body 78 having first been secured to cabinet floor 24, cabinet 10 is then guided into engagement with sub-base 32. When cabinet 10 is lowered in place, drain fitting 70 is telescopingly received within drain body 74, seal 78 being then only loosely received upon fitting 70. Caulking nut 80 is then inserted. It is readily tightened by a so-called caulking wrench 94 of bar-like character, having a central bar portion 96, including a slot 98 for receiving a screwdriver, and narrowed tab-like extensions 99 at opposite ends configured for being received within corresponding slots, as at 101, of caulking nut 80. Rotation of wrench 82 tightens nut 80 to tightly compress and clamp rubber seal 78 in water-tight condition about the periphery of drain fitting 70. Then, a strainer 103 may be fitted to drain body 82, as shown in FIGS. 4 and 5.

Drain pipe 34 is provided with a locking nut 104 and O-ring washer 106 for connection of an additional drain pipe extension for more remote drainage than provided by drain pipe 34, or for connection to an elbow to direct water downwardly into a surface drain.

The resultant construction is, accordingly, seen to result from a minimum number of separate components, yet achieving a degree of reliability, strength and ease of construction hitherto unavailable. Moreover, the construction absolutely minimizes elevation of the cabinet floor 24 above the supportive surface, yet sub-base 62 provides the advantages not only of supporting and distributing substantial weight but also of preventing substantial stress or strain from being imparted to the drain assembly 66 resulting from flexing of cabinet floor 24, even under the weight of a very heavy person. Further, moisture is readily repelled by the conventionally sealed surface of the styrofoam material of sub-base 62 but the same may be provided, if desired, with a layer of PVC or other finishing material, as well as adhesive material if desired for fixing location for facilitating installation.

The design of the base extension and its components allows it to be knocked down and shipped in a relatively compact package as a kit for use optionally with existing shower enclosures or shipped with a knocked down enclosure for use with same but without greatly adding to the total cubage of the shower kit packaging. Thus, commercial flexibility is attained in a most economical, practical manner.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A free-standing shower for permitting remote drain discharge, comprising a rectangular shower cabinet having a wall structure defining a peripheral base edge at its lower end and including a floor having a central drain, a base extension seated upon a supportive surface for supporting the base edge around the periphery thereof for elevation of the floor from the supportive surface to define a space between the floor and the supportive surface, the base extension including means for receiving and grippingly engaging the cabinet base edge, the base extension being formed of four joined members each carrying interlocking means for interlocked engagement with an adjacent one of such members, the joined members defining a four-sided rectangular configuration corresponding to the cabinet, each such member being L-shaped including an elongated portion and an integrally perpendicular short portion, a sub-base within the space so defined for supporting the floor by evenly distributing weight to a relatively large area beneath the cabinet, the sub-base including a drain pipe assembly and fixing the location of such assembly for connection to the central drain, the sub-base constituted by a block of lightweight synthetic structural material including a central recess and a lateral recess extending radially from the central recess to the outer periphery of said block for receiving the drain pipe assembly, the drain pipe assembly having a drain fixture positioned within the central recess and the drain pipe being positioned within the lateral recess, the drain pipe extending laterally beyond the base extension, thereby providing drain discharge at a location remote from the shower.

2. A free-standing shower according to claim 1 and further characterized by integrally molded flanges and tabs along upper edges of the side members for resiliently, grippingly engaging the cabinet base edge.

3. A free-standing shower according to claim 1 and further characterized by the interlocking means being constituted by the opposite end of each member defining respectively an engaging extension and an engaging recess for mutual engagement with a corresponding recess and extension of adjacent such members.

4. A free-standing shower according to claim 3 and further characterized by the engaging extension being of wedge configuration, the recess being also of wedge configuration and defined by a V-shaped structure of the respective member.

5. A free-standing shower according to claim 1 and further characterized by the drain fixture including a central portion below and communicating with the cabinet drain, and a lateral portion of diminshed height for communicating with the drain pipe, said height being less than the diameter of the drain pipe to provide thereby a trap-like configuration.

6. A free-standing shower according to claim 5 and further characterized by the cabinet having a central drain aperture including a drain body fitted within the aperture for providing said drain, the drain body telescopingly receiving the drain fixture, an annular seal fitted within the drain body, and a caulking nut threadably engaging the drain body for compressing the seal to provide water-tight sealing between the drain body and drain fixture.

7. A free-standing shower according to claim 6 and further characterized by the caulking nut being radially slotted for receiving a bar-like caulking wrench in spanwise relationship centrally therein for tightening of the caulking nut.

* * * * *